United States Patent [19]

Martin

[11] Patent Number: 5,033,641

[45] Date of Patent: Jul. 23, 1991

[54] REFUSE CONTAINER WITH MULTI-POSITION DIVIDER

[76] Inventor: Gary G. Martin, 113A Essex Cir., Guilderland, N.Y. 12084

[21] Appl. No.: 491,302

[22] Filed: Mar. 9, 1990

[51] Int. Cl.[5] ..... B65D 85/00

[52] U.S. Cl. ..... 220/909; 220/533; 220/527

[58] Field of Search ..... 220/909, 533, 546, 527

[56] References Cited

U.S. PATENT DOCUMENTS

| | | | |
|---|---|---|---|
| 3,402,848 | 9/1968 | Busey . | |
| 3,720,346 | 3/1973 | Cypher | 220/909 |
| 4,346,813 | 8/1982 | Cho et al. . | |
| 4,428,493 | 1/1984 | McDonough . | |
| 4,577,773 | 3/1986 | Bitel | 220/533 |
| 4,593,816 | 6/1986 | Langenbeck | 220/533 |
| 4,702,402 | 10/1987 | Ferri | 220/533 |
| 4,729,489 | 3/1988 | Papaianni . | |
| 4,867,328 | 9/1989 | McCarthy | 220/909 |
| 4,874,111 | 10/1989 | Heller | 220/909 |
| 4,905,853 | 3/1990 | Strawder | 220/909 |
| 4,913,308 | 4/1990 | Culbertson | 220/909 |

*Primary Examiner*—Joseph Man-Fu Moy

*Attorney, Agent, or Firm*—Schmeiser, Morelle & Watts

[57] ABSTRACT

A segregated trash receptacle which employs a multi-position divider. Also disclosed in combination with the securing member for an upper portion of the divider is a plurality of upwardly extending fingers for securably engaging a flexible bag. A shaped hook member is also taught which includes a securing portion and bag receiving portion. The invention may be fashioned using a container or be produced in a kit form for attachment to existing containers.

12 Claims, 3 Drawing Sheets

REFUSE CONTAINER WITH MULTI-POSITION DIVIDER

FIELD OF THE INVENTION

The invention is in the field of trash receptacles. More particularly, the invention is in the field of trash receptacles that have interior, segregated volumes.

BACKGROUND OF THE INVENTION

Trash receptacles are found in every home and have remained unchanged in design for almost their entire history. They are normally sold in 5 gallon to 50 gallon sizes and often have either removable covers or covers that are hingedly connected to the body of the receptacle.

Lately, changing laws in many localities are radically changing the way people dispose of their trash. These laws reflect environmental concerns over rapidly filling landfills and the incineration of toxic wastes. Most of these laws now require the recycling of certain waste materials to reduce energy costs and especially, to reduce the deleterious effect on the environment these waste materials may cause. Typically, the homeowner is required to separate bottles, cans and newspapers from the rest of the household trash. This has created a storage problem for the average homeowner.

At the present time, the most common method of separating trash relies on the homeowner using a number of separate waste receptacles. This often requires one to carry the different waste products to different parts of the home (kitchen, closet, garage, basement) depending on the type of waste involved.

There are a number of other problems associated with the present methods of recycling. For those who previously had a single area in which a trash receptacle was kept (for example, in a kitchen cabinet beneath the sink), the area cannot be modified to accommodate the plurality of receptacles now required. For the people who use only small quantities of cans, bottles, etc., using a large trash can for each item is economically impractical and requires an excessive amount of storage space.

A primary method of overcoming the above noted problems has been the recent design of multi-compartmented trash receptacles. Receptacles of this kind can be seen in the patents issued to Papaianni (U.S. Pat. No. 4,729,489) and McDonough (U.S. Pat. No. 4,428,493). Both these patents show unitary trash receptacles that have compartments segregated from each other by a fixed divider. These containers, while alleviating some of the problems associated with recycling, suffer from certain other problems.

In both Papaianni and McDonough, the compartments can receive flexible, removable bags. The bags are suspended within the compartments by frictional engagement of the bag's top edge with the top lip of the container. As the bag is filled, the added strain on the top of the bag can lead to its inadvertent disengagement from the container lip and subsequent slippage into the interior of the compartment.

In addition, the fixed dividers do not allow any modification of the volumes of the segregated compartments that might be required for the convenience of the user to reflect individual needs. For instance, for the user who buys 3 liter soft drink containers, the portion of the waste receptacle devoted to the receipt of these containers should be wide enough to accept these extra-large containers. On the other hand, a user who only needs space to receive a few 12 ounce cans would only need a small volume devoted for these small containers.

Two final problems unsolved by the prior art are firstly, the lack of a usable method of partitioning large trash cans (30–50 gallon volume) so that they can be used to hold diverse items in separate compartments. Secondly, there is no teaching in the prior art of a modification to the receptacles that will allow the secure engagement of both plastic flexible bags of the variety now commonly used by supermarkets for the bagging of groceries and also, large trash bags.

SUMMARY OF THE INVENTION

The invention is a trash receptacle that employs a movable divider and a combined divider securing member and bag holder. The receptacle of the instant invention makes use of standard sized trash containers that have at least two substantially parallel sides.

By making use of standard sized receptacles, one can store the multi-compartmented receptacle in the same location that was previously used for the single compartment receptacle. An additional benefit lies in the fact that one can use a standard sized large receptacle (30–50 gallon container) to house two or more different types of recyclables.

The movable, multi-position divider allows the user to customize the segregated compartments to his or her own requirements. If equal volume compartments are required, the divider can be located in the center of the container. The divider can similarly be located off-center to provide a large area compartment and a small area compartment and thus be adaptable for the user who wishes to devote a larger or smaller compartment area to a particular product.

The multi-position divider requires both a bottom securing means and a top securing means. The top securing means also includes a simple mechanism for engaging the flexible bag(s) which are received within the segregated compartments. The mechanism includes a plurality of upwardly extending members that are located on the upper portion of the top divider securing means and are atop the parallel sides of the container. These members are closely spaced and can be used to secure bags by either of two methods.

The first method is used with the common variety of supermarket plastic bags which are provided for bagging purchased groceries. These bags have built-in handles consisting of a hole in a looped upper portion of the bag. For this type of bag, each bag handle is placed over one or more of the projections and both sides of the bag are thereby secured in place on opposite sides of the container.

The second method is used with plastic or paper bags that do not have handles. The top inch or so of the bag is bent outwardly and downwards thereby forming a U-shaped lip at the top of the bag. The outer side of the lip is then threaded through the projections in a torturous manner i.e.—the bag edge goes first around an outer projection surface, then threads between projections and goes around the next projection's inner surface, then threads outwardly before the next projection, encircles its outer surface, and so on. In this manner, the bag is securely fixed but is easily removable.

In an alternative embodiment of the bag securing means, at least one pair of modified hook members are secured to the top of the divider securing member. The hook members can be used either in addition to, or in place of, the upwardly extending projections. These hooks are shaped so that they can easily capture the handles of standard plastic grocery bags. In addition, the hooks may be slidably secured to the top of the divider securing means thereby allowing adjustable hook placement for different bag or compartment sizes.

The bottom divider securing means comprises a series of upwardly extending, spaced projections located on the upper surface of the container bottom. These projections are spaced to snugly receive the bottom of the divider between adjacent projections. Preferably, two rows of projections are used to secure opposite ends of the divider bottom.

The preferred embodiment of the invention is a complete receptacle system in which the body of the container includes the bottom divider securing members as a built in component. The upper divider securing means and bag securing means are combined in a single and separate unit which lockably engages the top of the container body. Once the above two parts are assembled, the divider is inserted into its two securing means in a position to provide the preferred volumes of segregation. Once in place, an optional cover can be mounted onto the top of the container. Optionally, the cover can be hingedly connected to the container body and be pivoted into a closed position.

As an alternate embodiment, the system can be sold as a kit for attachment to a standard rectangular or square trash receptacle. The bottom divider securing means can be attached to the inner surface of the receptacle bottom by fasteners or glue. The top divider securing means can be a snap fit over the top edge of the sides or be attached with glue or fasteners. The divider can be adjustable in length through the use of a telescoping member or, more economically, the divider can be sold in a maximum length condition and be perforated across its width so that a bottom portion(s) can be easily removed to thereby shorten it to its proper length to fit the container.

DETAILED DESCRIPTION OF THE DRAWINGS

Figure 1:
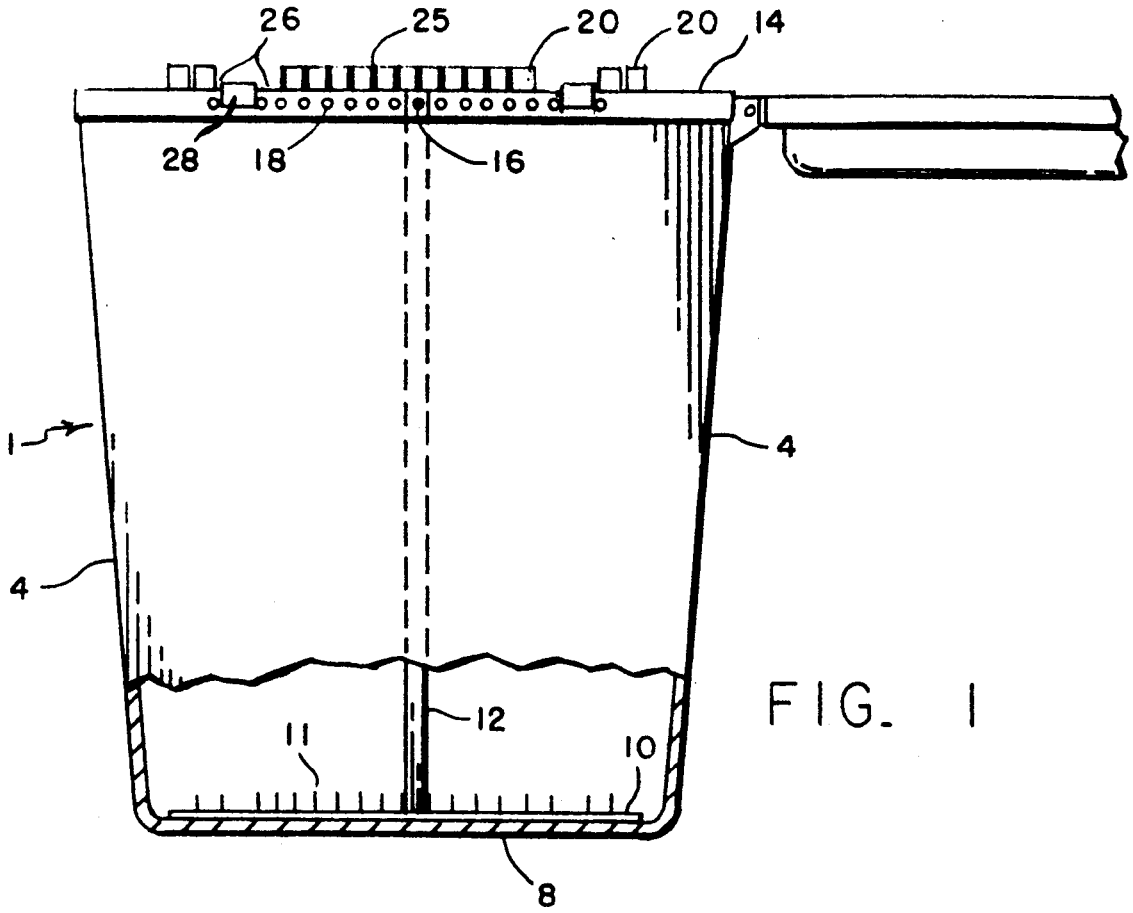
FIG. 1 is an elevational and partial cutaway view of the invention.
Figure 2:
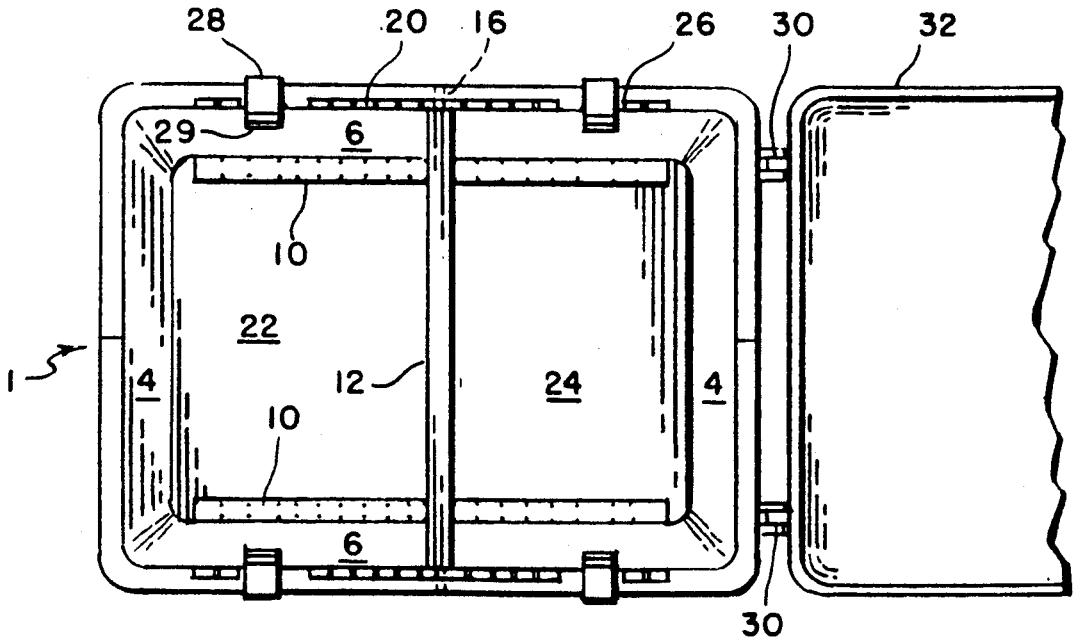
FIG. 2 is a plan view of the invention.

FIGS. 1 and 2 show a waste receptacle 1 of the invention. The receptacle is square or rectangular in shape and has parallel opposite sides 4, 6 and a flat bottom, 8. Located on the inner surface of the bottom are a pair of divider securing strips 10 which fixedly retain a bottom portion of a divider 12.

The top of the divider 12 is secured in place by the upper divider securing member 14. The manner of securement relies on the use of horizontally oriented divider securement members 16 fitting into a pair of the holes 18 located in the upper divider securing member 14. Situated on a top portion of the upper divider securing member are a plurality of spaced, vertically oriented projections 20. These projections are used to secure a flexible bag or bags (not shown) that may be inserted into either of the compartments 22 or 24 separated by the divider 12. Between each projection there is either a narrow or wide gap. The narrow gaps 25 are sized to receive the flexible bag(s) as previously described (either in a tortuous manner or received within loop). There are a plurality of wide gaps 26 also located between some of the projections 20. Into these gaps are slidably mounted hook members 28 that each include a bag retaining member 29.

A pair of hinges 30, mounted on the body of the receptacle, hingedly connects a cover 32 to the body. The cover is sized to inwardly receive the top of the container including the upwardly extending projections of the securing member 14.

Each of the divider bottom portion securing strips 10 include a plurality of upwardly extending projections 11. These projections are in the form of cylinders and are spaced from each other by an amount approximately equal to the thickness of the divider 12. As an alternate embodiment (not shown), the strips can have a thickness similar to the height of the projections 11. A plurality of notches can be cut in the strip and these notches would receive the bottom of the divider. This embodiment therefore would provide a flat surface as the top of the strip(s) which would prevent inadvertant puncturing of the bottom of a bag placed within one of the compartments.

Figure 3:
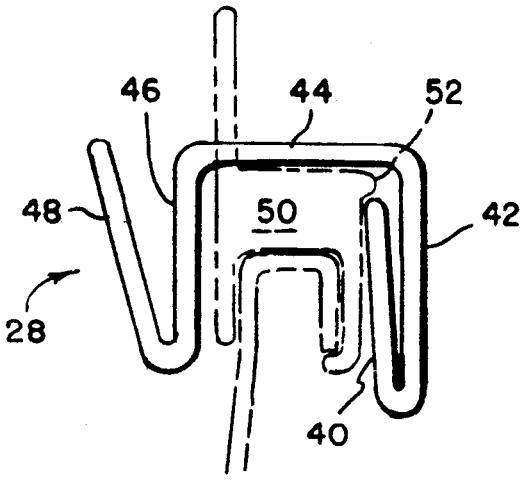
FIG. 3 is a cross-sectional view of a bag retaining hook.

FIG. 3 shows a more detailed view of a hook member 28. The hook member is made up of a number of straight sections 40, 42, 44, 46 and 48. It is fashioned from a semi-rigid material such as PVC plastic which is essentially rigid but can be slightly flexed without breaking.

As can be seen in the figure, the top portion 50 of the securing member 14 in the area of the gaps includes a lip 52. The lip fits within a channel shaped portion of the hook (42, 44, 46). As portion 50 of the securing member enters the channel shaped portion of the hook, finger section 40 of the hook is temporarily deformed or bent towards Section 42 until the lip 52 passes beyond its tip. The finger section 40 then resiliently returns to its former position and thereby slidably locks the hook member to the top of the securing member.

Connected to the bottom of section 46 is another finger element, section 48. Once the hook is in place on the container, this section extends into the interior of the container and functions to receive or hang the handle portion of a plastic bag (not shown). It should be noted that the hook is designed to be mounted on the divider securing member. However, the hook can also be mounted on a conventional container. In this way, the hook can be sold separately to allow modification of a conventional receptacle for hanging a plastic bag therein.

Figure 4:
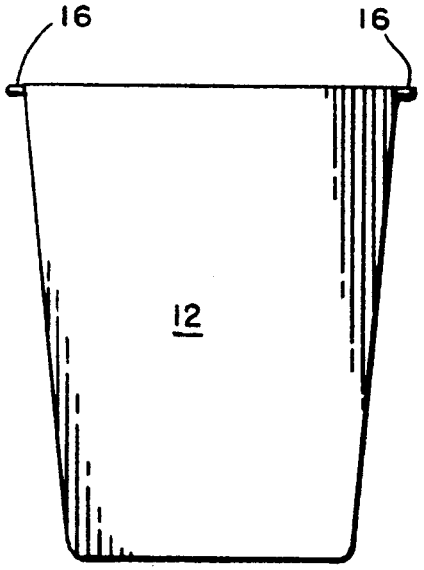
FIG. 4 is a front view of a divider.

FIG. 4 shows a front view of the divider 12. The divider is fashioned from a rigid or semi-rigid material such as wood, metal or plastic. Located on the top portion of the divider are a pair of horizontally oriented projection members 16 which can be received into any pair of holes 18 in the top divider securing member.

Figure 5:
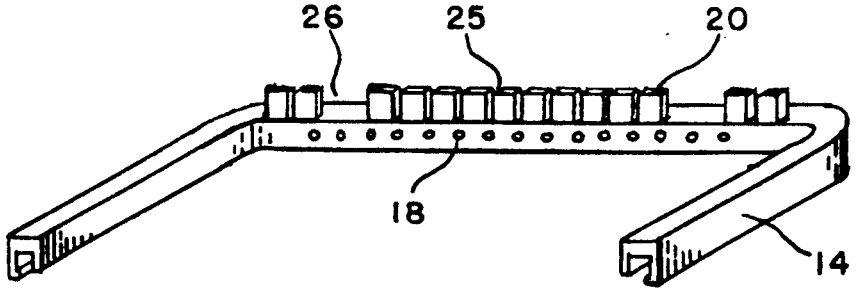
FIG. 5 is a perspective view of half of the snap-on top divider securing means.

FIG. 5 shows a perspective view of half of the upper divider securing member 14. In this view can be seen the projections 20, divider receiving holes 18, small gaps 25, wide gaps 26 and the general shape of the member. Preferably, the upper divider securing member would be formed from two of the shown half-units.

Figure 6:
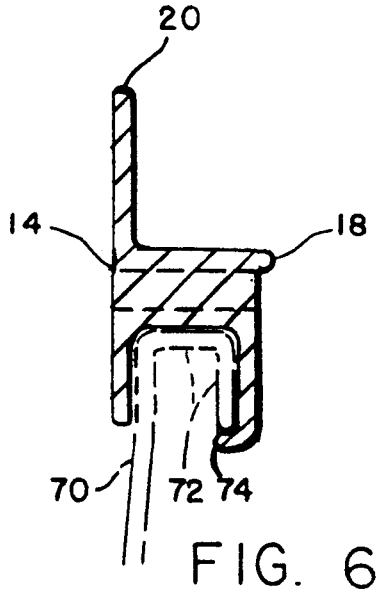
FIG. 6 is a cross-sectional view of a portion of the snap-on top divider securing means.

FIG. 6 is cross-section of a portion of member 14. The top portion 70 of the container walls includes an outwardly extending lip 72. The lower portion of member 14 is channel shaped and included an inwardly extending ridge 74. The member 14 is preferably made of a semi-rigid material that allows a modicum of flexibility. When attaching the member 14 to the container walls, entry of the lip 72 causes the bottom portion of the channel to expand until the ridge 74 passes beyond lip 72. Once passed, the channel resumes its former shape and thereby becomes securely fixed to the upper container portion 70. In this view, the holes 18 (shown in phantom) can also be seen. It should be noted that a comparable locking actin would result if alternatively, the member 14 is made of a rigid material and the container walls are semi-rigid.

The preferred embodiment as described to this point is a complete receptacle system. As an alternative embodiment, a component system can be used to modify an ordinary or existing refuse container having parallel walls to an approximation of the preferred embodiment. Once modified, an existing container would include all of the advantages of the instant invention.

Figure 7:
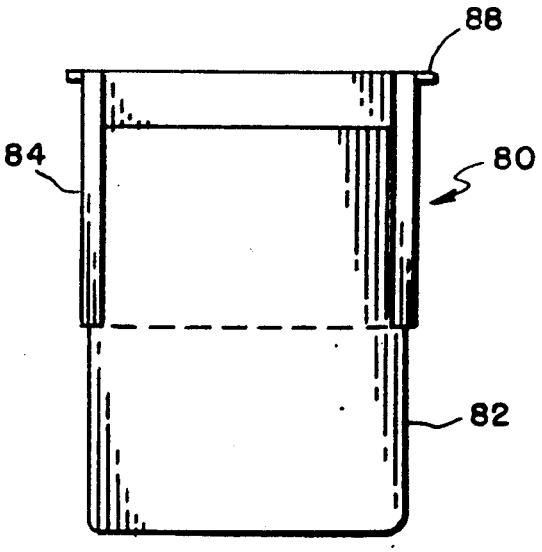
FIG. 7 is a front view of an extendible divider.
Figure 8:
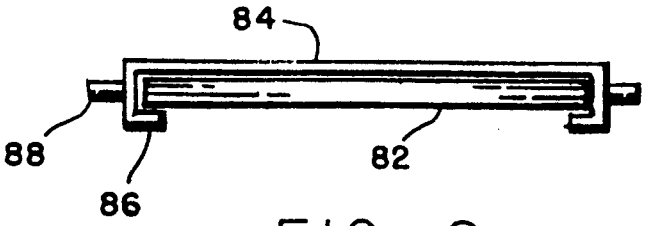
FIG. 8 is a plan view of the divider of FIG. 7.

Hence, a kit or component form of the divider securing means can be produced for attachment to an ordinary receptacle. The kit includes an adjustable length divider 80 (FIG. 7) in which a bottom portion 82 is telescopically engaged with a top divider portion 84. As can be seen in FIG. 8, the top divider portion is channel shaped with inwardly extending flanges 86 which prevent sideways separation of the two divider portions. The top divider portion also includes horizontal projections 88 similar in design and function to divider projections 16.

Figure 9:
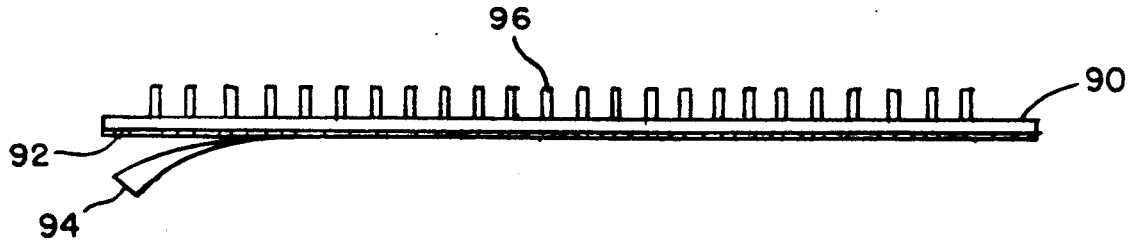
FIG. 9 is a cross-sectional view of a stick-on securing means for retaining the bottom portion of the divider.

FIG. 9 shows a retaining strip 90 which can be used singly or in pairs for retaining the lower portion of the divider 80. The bottom of the strip includes a layer of glue 92 with its surface covered by a strip of tape 94. On its top surface, each strip includes a plurality of projections 96.

To modify an existing receptacle, one would take a pair of retaining strips 90, remove each of their tapes 94 and secure them to the upper surface of the receptacle bottom in a parallel, spaced orientation.

Next, the upper divider securing member 14 of the correct size to fit the container would be placed onto the upper portion of the container walls. If the walls do not have an outwardly extending lip, glue or fasteners (such as self-tapping sheet metal screws or the like) can be used to secure the member 14 in place.

As noted previously, FIG. 5 shows one half of the member 14 and a pair of members would normally be used to make up the complete member. For the system in kit form, the securing member can also be fashioned from a pair of members that include just the bag receiving sections of member 14 which include the upwardly extending projections 20 and holes 18. These members could either be a standard length or be the maximum envisioned length and could be shortened by the user by any of a number of methods in order to fit the container. These methods could include the use of scissors, tin snips or placing perforations in the member so that end portions could be somewhat easily broken off from the main member. Removal of the ends allows the user to provide an exact fit of the main member to the container wall. Once of the correct length, the members can be attached by the methods previously described.

In operation, one would first place the divider within the container in a position wherein the container is segregated into portions that best fulfill the user's needs. To accomplish this, the user would place the bottom end of the divider 12 within the appropriate set of bottom retaining strip projections 11. Next, with the divider in a near vertical position, the sides of the divider would be flexed until the plane of the divider assumed an arcuate shape. The divider would be pushed down until the divider projections 16 (or 88) are in the same plane as the securing member holes 18. The divider would then be released. The projections would be aligned with the appropriate holes of the securing member 14. Once the projections are received in the holes, the divider would be securely locked in position. Next, either a plastic trash bag or plastic grocery bag would be affixed to either the upwardly extending projections 20 or hook members 28. The receptacle would then be ready for use.

It should also be noted that if a rigid divider is used, its horizontal projections 16 can be received within slots (not shown) in member 14 that would take the place of holes 18.

The embodiments disclosed herein have been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A segregated waste receptacle comprising:

a container means, said container means having at least two substantially parallel sides, a top perimeter edge and a bottom surface that connects and is perpendicular to said substantially parallel sides;

a first divider securing means located on said bottom surface of said container means in an area spaced from said parallel sides, said first divider securing means including means for removably securing a bottom portion of a divider in any one of a plurality of spaced locations;

a second divider securing means located atop said top perimeter edge of said container means, said second divider securing means including means for fixedly securing a top portion of a divider in any one of a plurality of spaced locations;

a divider located inside said container means for adjustably segregating an interior volume of said container means into two separate volumes, said divider having a bottom portion removably secured by said first divider securing means and having a top portion removably secured by said second divider securing means; and a bag hanging means located on a top portion of said second divider securing means for hanging at least one flexible bag within at least one of said separate volumes within said container means.

2. The receptacle of claim 1 further comprising a cover means for said container means, said cover means having a bottom portion sized to inwardly receive at least a portion of said second divider securing means.

3. The receptacle of claim 2 wherein said cover means is hingedly connected to said container means.

4. The receptacle of claim 1 wherein said divider has side edges and said first divider securing means comprises at least three spaced, upwardly extending projections whereby the bottom portion of said divider between said divider side edges is removably received and engaged between adjacent projections and whereby one can change the position of the bottom portion of said divider by lifting it up out of engagement with a set of projections and then pushing it down to engage a different set of projections.

5. The receptacle of claim 1 wherein said second divider securing means comprises a plurality of holes spacedly located above the top of said parallel sides of said container means and said top portion of said divider includes two horizontally oriented projections which removably engage two of said holes.

6. The receptacle of claim 1 wherein said second divider securing means is a separate removable element that includes securing means for securably engaging a top edge of said container means.

7. The receptacle of claim 1 wherein said bag hanging means is located atop said second divider securing means and comprises a plurality of spaced, vertically oriented, upwardly extending projections around which a top portion of said flexible bag may be received.

8. The receptacle of claim 6 wherein said bag hanging means forms a top portion of said second divider securing means and comprises a plurality of spaced, upwardly extending projections around which a top portion of said flexible bag may be received.

9. The receptacle of claim 1 wherein said bag hanging means comprises at least two hook means, said hook means including a securing means for securably engaging a top edge of said second divider securing means and wherein at least one hook means is at least partially located above a top edge of each of said parallel sides of said container means.

10. The receptacle of claim 6 wherein said bag hanging means comprises at least two hook means and wherein each of said hook means includes a securing means adapted to engage a top edge of said second divider securing means and wherein at least one hook means is located adjacent each of said parallel sides of said container means.

11. The receptacle of claim 7 wherein said bag hanging means further comprises at least two hook means removably secured to said container means and located on said second divider securing means in spaces between said upwardly extending projections wherein at least one hook means is located at least partially above each of said parallel sides of said container means.

12. The receptacle of claim 11 wherein the spaces that receive the hook means are longer than said hook means whereby said hook means can be adjustably horizontally located on said second divider securing means within said spaces between said upwardly extending projections.

* * * * *